US006345726B1

(12) United States Patent
Beeuwsaert

(10) Patent No.: US 6,345,726 B1
(45) Date of Patent: Feb. 12, 2002

(54) PACKAGE FOR SOLID, LIQUID OR PASTY PRODUCTS

(75) Inventor: Bernard Beeuwsaert, Bousbecque (FR)

(73) Assignee: Wipak Gryspeert Societe Anonyme, Bousbecque (FR)

( * ) Notice: Subject to any disclaimer, the term of this patent is extended or adjusted under 35 U.S.C. 154(b) by 0 days.

(21) Appl. No.: 09/442,414

(22) Filed: Nov. 18, 1999

(30) Foreign Application Priority Data

Dec. 1, 1998 (EP) ..... 98490032

(51) Int. Cl.[7] ..... B65D 41/32

(52) U.S. Cl. ..... 220/359.3; 220/359.2; 220/359.4; 220/62.13; 220/62.22; 428/35.7

(58) Field of Search ..... 220/359.1, 359.2, 220/359.3, 359.4, 62.13, 62.22; 428/35.7, 220, 474.4, 138, 34.2

(56) References Cited

U.S. PATENT DOCUMENTS 4,589,568 A * 5/1986 Ito et al. ..... 220/359.3
4,689,099 A * 8/1987 Ito et al. ..... 220/319 X
4,913,307 A * 4/1990 Takata et al. ..... 220/276
5,116,651 A * 5/1992 Katsura et al. ..... 428/35.7
5,118,002 A * 6/1992 Sugiyama et al. ..... 428/35.7
5,160,391 A * 11/1992 Thomas, Jr. ..... 220/359.4
5,178,293 A * 1/1993 Suzuki et al. ..... 220/359.3
5,316,603 A * 5/1994 Akazawa et al. ..... 156/69
6,010,759 A * 1/2000 Yamada et al. ..... 428/35.7
6,033,758 A * 3/2000 Kocher et al. ..... 428/138

* cited by examiner

*Primary Examiner*—Stephen P. Garbe
(74) *Attorney, Agent, or Firm*—Harrison & Egbert

(57) ABSTRACT

A package (1) for solid, liquid or pasty foodstuffs or for medical products, the package allowing for simple opening and reclosing of a cover over the package, the package comprised of a rigid or flexible tray (2) of multi-layer thermoplastic material. The thermoplastic material comprises an outer supporting layer (5) of amorphous polyester, an intermediate layer of permanent adhesive (6), and an inner, weldable layer (7) of polyethylene. The cover (3) comprises a weldable layer of polyethylene or a thermoformable structure similar to that of the tray. The package includes an impermeable pouch which receives the contents and which is delimited by the weldable layer (7) of the tray, the weldable layer (3) forming the cover, and the weld bead (4).

9 Claims, 2 Drawing Sheets

PACKAGE FOR SOLID, LIQUID OR PASTY PRODUCTS

TECHNICAL FIELD

The invention relates to a package for the packaging of solid, liquid or pasty foodstuffs, such as dairy products, delicatessen products and meats, and of medical products.

It will be used in industries for the manufacture of films for food and packages, and for the packaging of foodstuffs subsequently made available to consumers in shops. The use of packages for solid or pasty foodstuffs has long since been known. They consist, of a tray and a cover, also referred to as a seal, made from a thermoformable film suitable for contact with food.

Foodstuffs can be packaged in accordance with the following steps: the roll of plastic film is unwound, then thermoformed in order to produce the tray. The tray is then filled with the foodstuff to be packaged. The cover is then closed over the tray by welding, after the injection of an inert gas in order to preserve the foodstuff.

When the package is opened at the time of consumption of the foodstuff, the weld is broken by the user and the cover is separated from the tray. It is then impossible for the cover to be reclosed over the tray, forcing the user either to consume the product all at once or to use a protective film to preserve the freshness of the product or to prevent the odors from the product spreading within the refrigerator.

It is known in the prior art to produce packages for foodstuffs provided with a device for reclosing the cover over the tray.

The tray is made by thermoforming from a rigid or flexible film of PVC, polyester or a similar plastic.

The cover used on the market today is made from a film consisting of three layers:

- an inner weldable layer welded along a bead against the edge of the opening of the tray,
- an outer layer which both forms the rigid element of the cover and provides protection against oxygen in order to preserve the food,
- an intermediate permanent-adhesive layer.

When the package is used for the first time, the weld bead is detached from the weldable layer and remains integral with the tray. The adhesive layer is then exposed on the cover at the weld bead. This allows the package to be reclosed after its first use and allows the product to be consumed in several portions over several days or several hours.

It has been noted that, when the cover is welded on to the tray, "pockets" are produced on the adhesive layer, these allowing the inert gas for preserving the foodstuff to escape and oxygen to penetrate into the package, thereby oxidizing the foods and reducing their shelf life.

As the adhesive layer is situated in front of the layer providing protection against oxygen, the "pockets" completely destroy the efficiency and properties of the oxygen barrier layer. This therefore means that the solid or pasty foodstuffs become perishable before they are first consumed and that the use-by date of the solid or pasty foodstuffs cannot be specified precisely.

These "pockets" are produced on the package when the cover is welded on to the tray as variations in temperature of the thermoforming machines and in welding pressures are too high or too low.

This invention remedies these disadvantages and one of its main aims is to provide a package for the packaging of foodstuffs, the manufacture of which allows the preservative inert gas to be kept perfectly within the package, thereby allowing for a precise guarantee of the shelf life of the product prior to the first use and therefore prior to the use-by date of the foods.

Another aim of this invention is to enclose the solid or pasty foodstuff within a pouch allowing the packaged product to be preserved in its entirety and without any deterioration of the latter.

Another aim is to eliminate the disadvantages resulting from "pockets" on the adhesive layer allowing the preservative inert gas to escape and oxygen to penetrate into the package, as, in this invention, the "pockets" on the adhesive layer no longer open into the pouch, which thus remains tight and impermeable.

This therefore provides more flexibility when using thermofoming machines, as the variations in temperature and welding pressure are no longer as important or significant and the machines therefore no longer require such strict temperature and pressure control. The aim of this is to simplify the technology used for control and therefore to reduce the cost thereof.

Another aim is to produce the package without any modification of the existing automatic thermoforming machines on the market, the processes for the manufacture of the package and for the packaging of the food product being identical to those existing at present.

Another aim of this invention is to provide a package with simple opening and reclosing of the cover over the tray, thereby dispensing with the need to use protective films to preserve the product when the latter is not consumed completely upon the first use. Reclosing the package also serves to keep the odours from the foodstuff within the package instead of spreading within the refrigerator.

Other aims and advantages of this invention will be clear from the following description given solely by way of a non-limiting example.

SUMMARY OF THE INVENTION

Package (1) for the packaging of solid, liquid or pasty foodstuffs, such as dairy products, delicatessen products and meats and for the packaging of medical products, allowing for simple opening and reclosing of a cover over the package, composed of:

- a rigid or flexible tray (2) using a thermoformable structure comprising:
  - an outer supporting layer (5) of amorphous polyester or the like,
  - an intermediate permanent-adhesive layer (6),
  - an inner weldable layer (7) of polyethylene,
- a cover (3) having a weldable layer of polyethylene, or a thermoformable structure similar to that of the tray (2), characterised in that the package (1) has an impermeable, tight pouch (8) which receives the foodstuff, defined by:

- the weldable layer (7) of the tray (2),
- the weldable layer forming the cover (3),
- the weld bead (4), in order to strengthen the hermetic seal of the package (1) and to preserve its tightness until the use-by date of the foodstuff (19) prior to the first opening of the package.

BRIEF DESCRIPTION OF THE DRAWINGS

The invention will be more readily understood from the following description with reference to the accompanying drawings, in which.

DETAILED DESCRIPTION OF THE INVENTION

This invention relates to a package (1) for the packaging of solid or pasty foodstuffs (19), such as dairy products, delicatessen products or meats. It will be used, inter alia, in industries for the manufacture of packages and for the packaging of foodstuffs and medical products subsequently made available to consumers in supermarkets or pharmacies. It may also be used for other ironmongery products.

Figure 1:
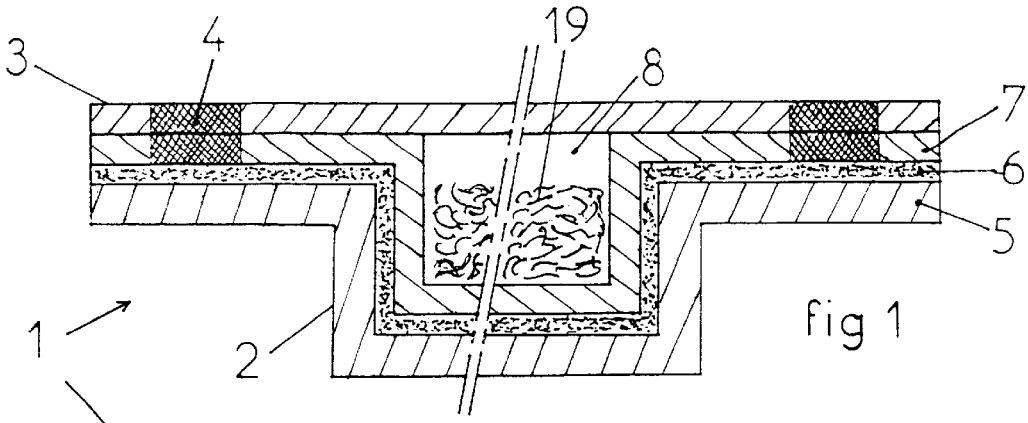
FIG. 1 is a highly enlarged diagrammatic cross section of the package (1) for solid or pasty foodstuffs (19) prior to its first use.
Figure 4:
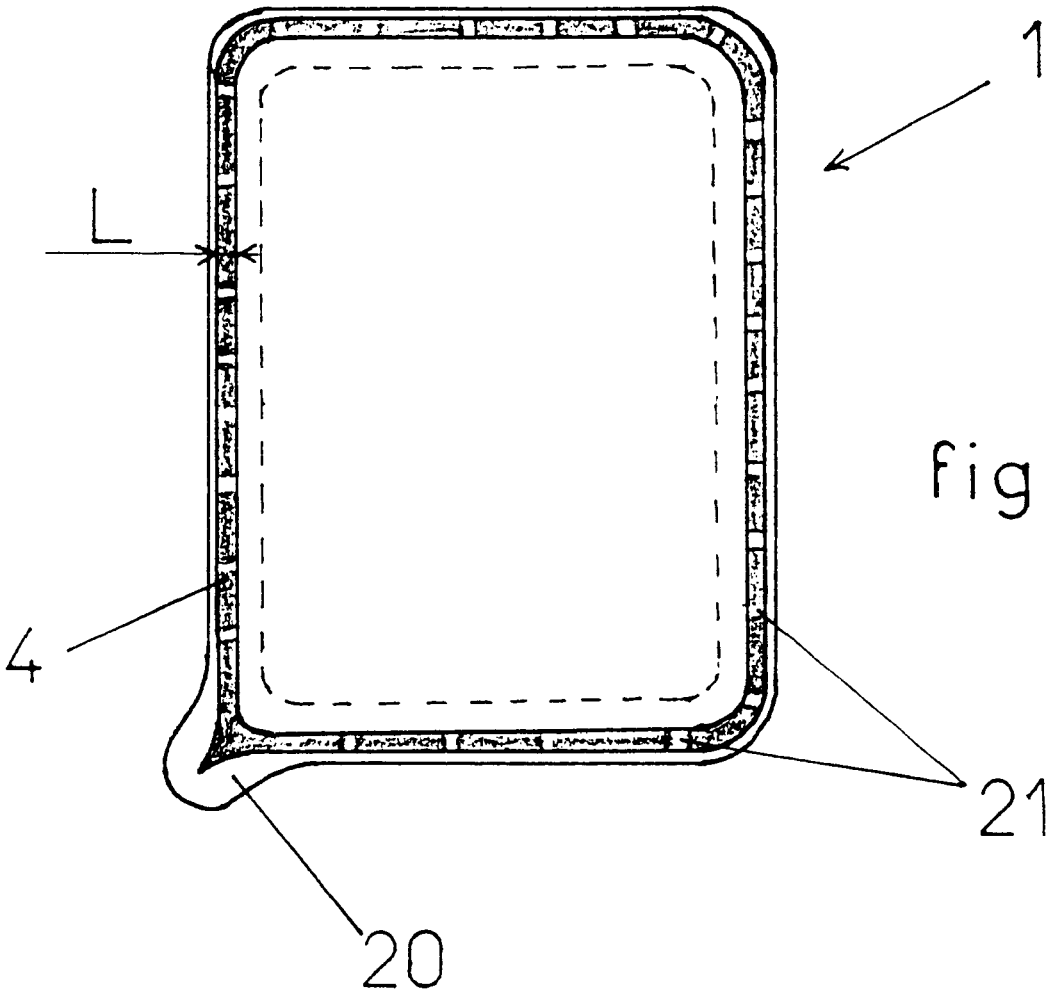
FIG. 4 is a diagrammatic top view of the package (1).

FIG. 1 shows the package (1) for foodstuffs (19). The package (1) includes a tray (2) and a cover (3), also referred to as a seal, these two elements being assembled by means of a weld (4). The weld (4) of the cover (3) is effected over the entire periphery of the tray (2), as shown by FIG. 4.

The tray (2) is made by means of a thermoformable structure in the form of a film. The film is composed, of at least three layers:

an outer supporting layer (5), an intermediate adhesive layer (6), an inner weldable layer (7) which will be in contact with the foodstuff.

In a preferred, but non-limiting embodiment, the outer supporting layer (5) is made of an amorphous polyester having a thickness which can vary from ten to five hundred microns or more depending on the rigidity, resistance or flexibility it is desired to obtain for the tray (2).

In another embodiment, it can be made of materials, such as PVC, polypropylene, polyethylene, expanded polyester, polyamide, polycarbonate or polystyrene.

The intermediate adhesive layer (6) is made by means of an adhesive resin or another thermoplastic synthetic material. It should have an almost permanent adhesive effect in order to provide gluing properties allowing the cover to be opened and reclosed several times when the product is consumed in several portions. Its thickness is preferably fifteen to twenty microns in order to ensure permanent gluing properties and to ensure the connection between the inner weldable layer (7) and the outer supporting layer (5).

Figure 2:
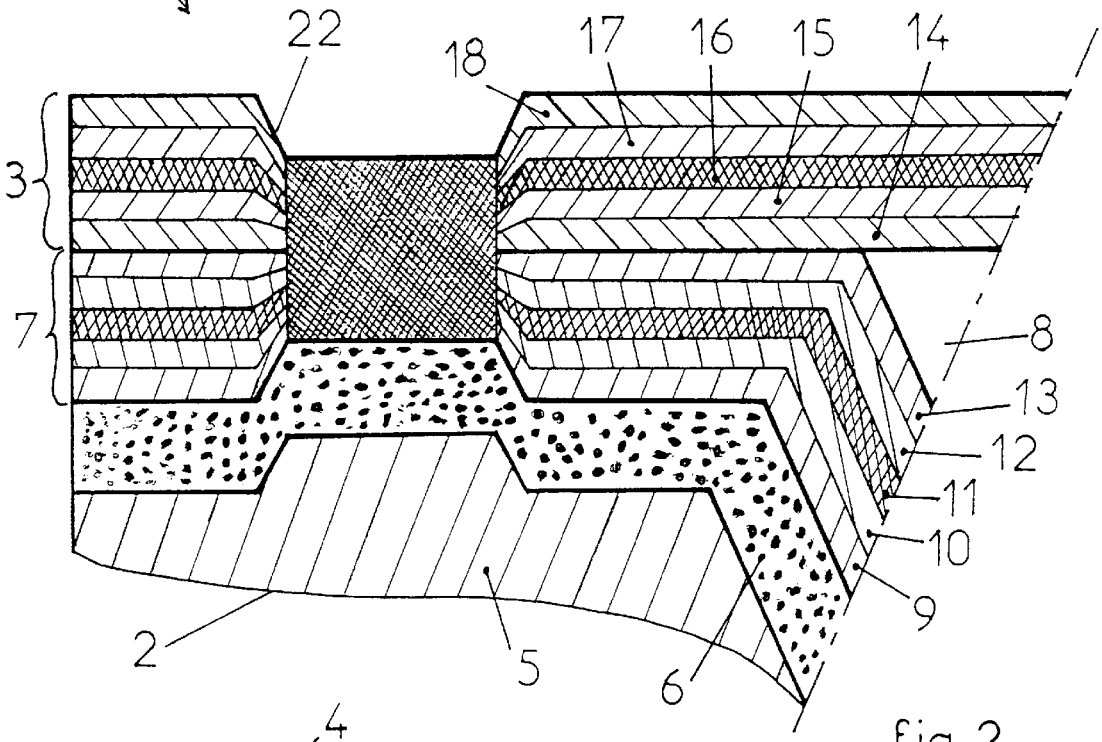
FIG. 2 is a detailed sectional view showing the composition of the weldable layers and the welding of these elements.

The inner layer (7) is made by means of a polyethylene preferably composed of five layers (9, 10, 11, 12 and 13), shown in diagrammatic form in FIG. 2, the total thickness of which is more than twenty-five microns. It must be suitable for welding and for fusion with another weldable layer of the same type. It must be suitable for welding and fusion to a sufficiently wide extent to be able to withstand temperature and pressure variations.

The cover (3) of the package (1) is of the same type as and of an identical structure to the weldable layer (7) of the tray (2). It is preferably composed of five layers (14, 15, 16, 17 and 18) shown in diagrammatic form in FIG. 2, made of polyethylene having a thickness of more than thirty microns and these properties must be identical to those of the weldable layer. It must have good dimensional properties allowing it to support the printing of ink and of text or images representing the solid or pasty foodstuff (19) contained in the package (1).

The thermoformable structure of the tray (2) is produced, by thermal deposition of the thermoformable synthetic permanent-adhesive layer (6) on to the supporting layer (5) of amorphous polyester by a coating process carried out at a temperature of approximately 160° C., then by lamination of the weldable layer (7) of polyethylene on to this adhesive layer (6).

The whole assembly is then unwound so as to form a reel ready to be cut for the thermoforming packaging machine.

Another technique used to produce the thermoformable structure includes of thermal extrusion of the adhesive resin forming the adhesive layer (6) between the supporting layer (5) and the weldable layer (7).

For the manufacture of the package (1) and the packaging of the product (19), the structure is, preheated to a temperature of 100 to 120° C. for a period of approximately two seconds, then it is formed on the cavities by means of air and suction in order to obtain the tray (2).

The tray (2) is then filled with the foodstuff or medical product (19) and an inert gas adapted to preserve the product is injected before the tray (2) is closed by the cover (3) by welding it at 160° C. for a period of 1.5 seconds at a pressure of 2.5 bar on to the periphery of the tray (2) by means of a weld bead (4) having a width L of 4 to 8 mm.

The parameters can be modified depending on the type of thermoforming machine used, these not being subjected to any modification in view of the fact that the process for the manufacture of the package remains identical to those already existing for conventional packages.

The weld is produced between the weldable layer forming the cover (3) and the weldable layer (7) of the tray (2).

In view of the properties of the two weldable layers, the latter are fused over the entire periphery of the tray (2) and over the entire width of the weld bead (4).

The package (1) thus has a water-impermeable and oxygen-tight or gastight pouch (8). This pouch (8) is delimited by the weldable layer of the cover (3), the weldable layer (7) of the tray (2) and the weld bead (4) over the entire periphery of the package (1). It therefore contains the foodstuff or medical product (19) and the inert gas adapted to preserve the product.

The weldable layer forming the cover (3) and the weldable layer (7) are preferably composed of five layers (14, 15, 16, 17, 18) and (9, 10, 11, 12, 13) respectively, the layers (11 and 16) being high oxygen barrier layers. The pouch is thus obtained by connecting and combining the high-barrier film and the cover (3), the high-barrier film and the weldable layer (7) and the weld bead (4), thereby ensuring its tightness and impermeability. The inert gas therefore remains in the pouch, simultaneously preventing the penetration of oxygen.

The oxygen or gas permeability, i.e. the quantity of oxygen penetrating into the package or the quantity of inert gas escaping from the package, will therefore be a maximum of 5 $cm^3.m^2/24$ hours.

The manufacturer can thus determine precisely the use-by date of the product (19) and ensure the quality of the foodstuffs (19) distributed to supermarkets.

The cover (3) and the weldable layer (7) should have of at least three layers, the central layer being the high oxygen barrier film in a preferred embodiment.

During the welding operation, the thermoforming machines are subjected to temperature and pressure variations. In the prior art, these variations produced "pockets" (21) on the adhesive layer in the radial direction of the tray (2), these allowing oxygen to penetrate into the package (1) and preservative inert gas to escape. These "pockets" (21) on the adhesive layer (6) still exist, but they are situated on the adhesive layer (6) outside the hermetic pouch (8) comprising a high oxygen barrier film. The "pockets" (21) therefore have no adverse effect on the package (1) as they do not open into the pouch (8).

The inert gas is duly preserved in the interior of the hermetic pouch (8) without any oxygen penetrating into the latter. The quality of the solid, liquid or pasty foodstuffs or medical products (19) is therefore preserved until their use-by date.

In addition, as these "pockets" (21) on the adhesive layer (6) no longer have an adverse effect on the packaging of the solid, liquid or pasty foodstuffs or medical products (19), the package manufacturers therefore have greater flexibility with respect to temperature and pressure variations of the thermoforming machines. The devices for controlling temperature and pressure on the machines can be simplified or less accurate, thereby reducing the cost of monitoring and control equipment.

Figure 3:
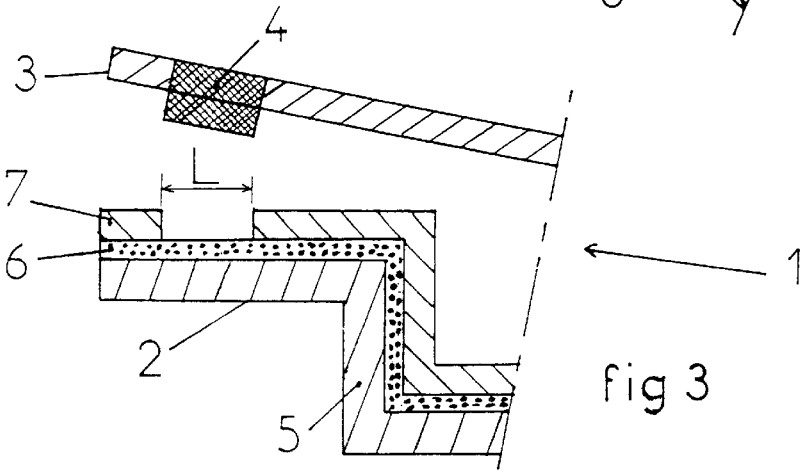
FIG. 3 is a diagrammatic sectional view of the package (1), with a reduced portion, after the first opening of the cover (3)

When the package (1) is opened for the first time for consumption of the solid or pasty foodstuff (19). the user exerts sufficient force to separate the weld bead (4) from the tray (2) at least over part of the periphery of the package (1) and removes the cover (3) from the tray (2), as shown in FIG. 3.

In order to carry out this operation, the consumer is provided with a tab (20) on the cover (3) of the package (1) promoting a better grip to pull on the cover (3) and separate it from the tray (2), as shown in FIG. 4. By separating the weld bead (4) from the tray (2), the consumer frees the permanent-adhesive layer (6) at the weld bead (4) over the entire periphery of the package (1) and opens the pouch (8). The pouch then losing its tightness and impermeability properties.

The solid or pasty foodstuff (19) is then in contact with oxygen and the preservative inert gas is no longer effective. The consumer must therefore consume the foodstuff (19) within a few days, after which time it will have lost its quality and its flavor and will be perishable.

The part of the adhesive layer (6) freed on the periphery of the package (1) has a width L equal to that of the weld bead (4). In a preferred embodiment, its width L is four to eight millimeters. The consumer can thus reclose the cover (3) over the tray (2) several times by virtue of the permanent effect of the adhesive layer (6). Reclosing the package (1) therefore keeps the remaining part of the foodstuff (19) protected from humidity in the refrigerator and also prevents the odours released by the product (19) from spreading within the refrigerator.

The consumer therefore no longer has to use protective film in order to obviate its disadvantages or is no longer forced to consume the product all at once.

So that the weld bead (4) can be separated from the tray (2) and not from the cover (3), the resistance of the weld bead (4) must be higher at the cover (3) than at the tray (2), i.e. promoting detachment of the weld bead (4) at the tray (2).

In order to achieve this, clamping pressure is exerted on the weld bead (4) at a given temperature, thereby promoting deformation (22) of the weldable layer (7) and of the cover (3). This deformation becomes permanent when the weld cools. These two elements are deformed as a result of the fact that they fuse and are subjected to pressure. On the other hand, the supporting layer (5) of the tray (2) undergoes virtually no deformation as a result of the nature of the material used, which fuses very little at the temperature applied.

Deformation of the layer (7) should therefore be promoted over deformation of the cover (3) in order to promote the detachment of the weld bead (4) from the tray (2). In order to emphasise this point, it is also possible to use a greater thickness for the weldable layer forming the cover (3) than for the weldable layer (7). Resistance will therefore be higher at the cover (3) than at the weldable layer (7) at the weld bead (4) when the consumer opens the package (1) for the first time.

Other embodiments of this invention within the competence of the person skilled in the art may be envisaged without thereby going beyond the scope of this invention.

What is claimed is:

1. A package for foodstuffs or medical products comprising:

a tray having an outer supporting layer of amorphous polyester and a weldable polyethylene inner layer and a permanent adhesive layer sandwiched between said outer supporting layer and said inner layer; and a cover of a weldable layer of polyethylene affixed onto said inner layer of said tray, said cover and said tray defining a pouch therein suitable for receiving the foodstuffs or medical products therein, said weldable layer of said cover and said inner layer of said tray having a weld bead extending around said pouch so as to hermetically seal an interior of said pouch, said weld bead being detachably secured against said permanent adhesive layer of said tray such that said weld bead separates from said permanent adhesive layer and said inner layer of said tray when said cover is detached from said tray.

2. The package of claim 1, wherein each of said inner layer of said tray and said weldable layer of said cover are of multiple layers of polyethylene, one of the multiple layers being an oxygen resistant barrier film.

3. The package of claim 1, wherein said weld bead is reattachable to said permanent adhesive layer.

4. The package of claim 2, wherein the multiple layers comprise three layers sandwiched together.

5. The package of claim 1, said inner layer of said tray and said weldable layer of said cover are fused together by said weld bead around a periphery of said tray.

6. The package of claim 1, said weld bead being separated from said inner layer and retained on said cover when the cover is detached from said tray.

7. The package of claim 1, said adhesive layer of said tray having a plurality of pockets formed therein and around a periphery of said tray, said adhesive layer extending entirely below said pouch and around a periphery of said pouch.

8. The package of claim 1, said supporting layer being of a thermoplastic material so as to allow said tray to be thermoformed.

9. The package of claim 1, said supporting structure having a thickness of more than 40 microns, said inner layer of said tray and said weldable layer of said cover each having a thickness in excess of 20 microns.

* * * * *